US007033129B2

(12) United States Patent
Bigoni

(10) Patent No.: US 7,033,129 B2
(45) Date of Patent: Apr. 25, 2006

(54) METHOD FOR FEEDING BLANKS TO A BOXING MACHINE

(75) Inventor: Pietro Bigoni, Massa Lombarda (IT)

(73) Assignee: I.M.A. Industria Macchine Automatiche S.p.A., Ozzano Emilia (IT)

( * ) Notice: Subject to any disclaimer, the term of this patent is extended or adjusted under 35 U.S.C. 154(b) by 0 days.

(21) Appl. No.: 10/495,416

(22) PCT Filed: Nov. 27, 2002

(86) PCT No.: PCT/IB02/04966

§ 371 (c)(1),
(2), (4) Date: May 12, 2004

(87) PCT Pub. No.: WO03/045825

PCT Pub. Date: Jun. 5, 2003

(65) Prior Publication Data

US 2005/0000193 A1 Jan. 6, 2005

(30) Foreign Application Priority Data

Nov. 29, 2001 (IT) ..... BO2001A0728

(51) Int. Cl.
*B65G 57/00* (2006.01)

(52) U.S. Cl. ..... 414/790.8; 414/798.4; 198/418.9

(58) Field of Classification Search ..... 198/418.9; 414/790.4, 790.6, 790.8, 798.4, 798.5, 798.2, 414/798.3

See application file for complete search history.

(56) References Cited

U.S. PATENT DOCUMENTS

| | | | | | |
|---|---|---|---|---|---|
| 3,832,823 | A | * | 9/1974 | Currie | 414/798.4 |
| 3,964,598 | A | * | 6/1976 | Alsop | 198/418.9 |
| 4,585,227 | A | * | 4/1986 | Muller | 198/418.9 |
| 4,635,428 | A | | 1/1987 | Nagao | |
| 5,244,342 | A | * | 9/1993 | De Dompierre | 414/790.8 |
| 5,354,170 | A | * | 10/1994 | Schweingruber et al. | 414/790 |
| 5,713,713 | A | | 2/1998 | Syde et al. | 414/403 |

FOREIGN PATENT DOCUMENTS

| | | | |
|---|---|---|---|
| DE | 2640496 A | | 3/1977 |
| EP | 0528772 A | | 2/1993 |
| EP | 0928761 A | | 7/1999 |
| JP | 55-16818 | * | 2/1980 |

* cited by examiner

*Primary Examiner*—James R. Bidwell
(74) *Attorney, Agent, or Firm*—William J. Sapone; Coleman Sudol Sapone P.C.

(57) ABSTRACT

A method for feeding blanks (2) to a boxing machine (AS), includes picking up, one by one, groups (20) of blanks (2) in flat configuration from a support surface and transporting, one by one, the groups (20) to a line (1) for continuously feeding the blanks (2) to the boxing machine (AS) in a predetermined forward movement direction (A). The transport step includes releasing each group (20) of blanks (2) between two adjacent prongs (13) defining a pocket (V) of a horizontal pocket conveyor (10, 11) of the feeding line (1). The releasing is performed by depositing the group (20) onto receiving and supporting means (23), which move from and to the conveyor (10, 11), in a direction crosswise to the forward movement direction (A), between a position, in which the receiving and support means (23) are slightly raised with respect to the surface (P), defined by the feeding line (1), and a position, in which the receiving and support means (23) are slightly lowered with respect to the surface (P), and a subsequent moving of the receiving and support means (23) from the raised position to the lowered position.

8 Claims, 4 Drawing Sheets

METHOD FOR FEEDING BLANKS TO A BOXING MACHINE

TECHNICAL FIELD

The present invention relates to feeding blanks to an automatic machine, in particular a boxing machine.

BACKGROUND OF THE INVENTION

Automatic boxing machines currently used pack articles into containers or boxes obtained by opening or erecting blanks of paper material stored in flat configuration.

The blanks in flat configuration are loaded onto a conveyor of the boxing machine feeding line, which transports them up to a gripping head, which picks them up and erects the flat blanks to the open configuration.

The blanks in flat configuration are usually loaded onto the conveyor arranged in horizontal piles, each pile being formed by a bunch of blanks arranged one beside another and vertically erected, called group of blanks hereinafter.

Each group of blanks is usually loaded manually by an operator onto the horizontal inlet conveyor, which defines the feeding line of the boxing machine.

Obviously, loading operation must be performed with such a frequency that ensures the continuity of the feeding of blanks and avoids interruptions in the boxing machine operation.

The development of modern boxing machines has allowed very high working speeds, which makes it very difficult, thus giving a burden to the operators to load manually the above groups of blanks onto the feeding line of the boxing machine.

Therefore, machines have been proposed which transfer automatically the groups of blanks to the feeding line of the boxing machine, by robotized means, which take single groups of blanks and load them onto the conveyor.

The use of the robotized means has solved the problem of continuous and effective feeding of the blanks to the boxing machine only partially.

Actually, although the robotized means are capable of loading efficiently and continuously the groups of blanks onto the conveyor of the boxing machine feeding line, they cannot ensure the maintenance of the correct mutual position of the blanks of two groups loaded one after the other, without displacements or overturning of the blanks, which could cause jamming and thus do not permit the continuity of the feedings of the blanks to the above gripping head, which would result in frequent and unproductive off-times of the boxing machine.

SUMMARY OF THE INVENTION

The object of the present invention is to propose a method for feeding blanks to a boxing machine, which solves the above described problems and ensures the continuity of the boxing machine operation, in particular during the steps with the machine high production rate.

In accordance with the present invention, a method is proposed for feeding blanks to a boxing machine, the method including picking up groups of blanks in flat configuration, one after another, from a support plane and transporting them, one after the other, onto a line for continuously feeding the blanks to said boxing machine in a predetermined forward movement direction; the method being characterized in that said transport step includes releasing each group of blanks between two adjacent prongs defining a relative pocket of a horizontal pocket conveyor of said feeding line, said releasing being performed by depositing said group onto receiving and supporting means, which move from and to said conveyor, in a direction crosswise to said forward movement direction, between a position, in which said receiving and support means are slightly raised with respect to said surface, defined by said feeding line, and a position, in which said receiving and support means are slightly lowered with respect to said surface, and a subsequent moving of said receiving and support means from said raised position to said lowered position.

BRIEF DESCRIPTION OF THE DRAWINGS

The characteristic features of the invention are pointed out in the following detailed description, with particular reference to the enclosed drawings, in which.

BEST MODES OF CARRYING OUT THE INVENTION

Figure 1:
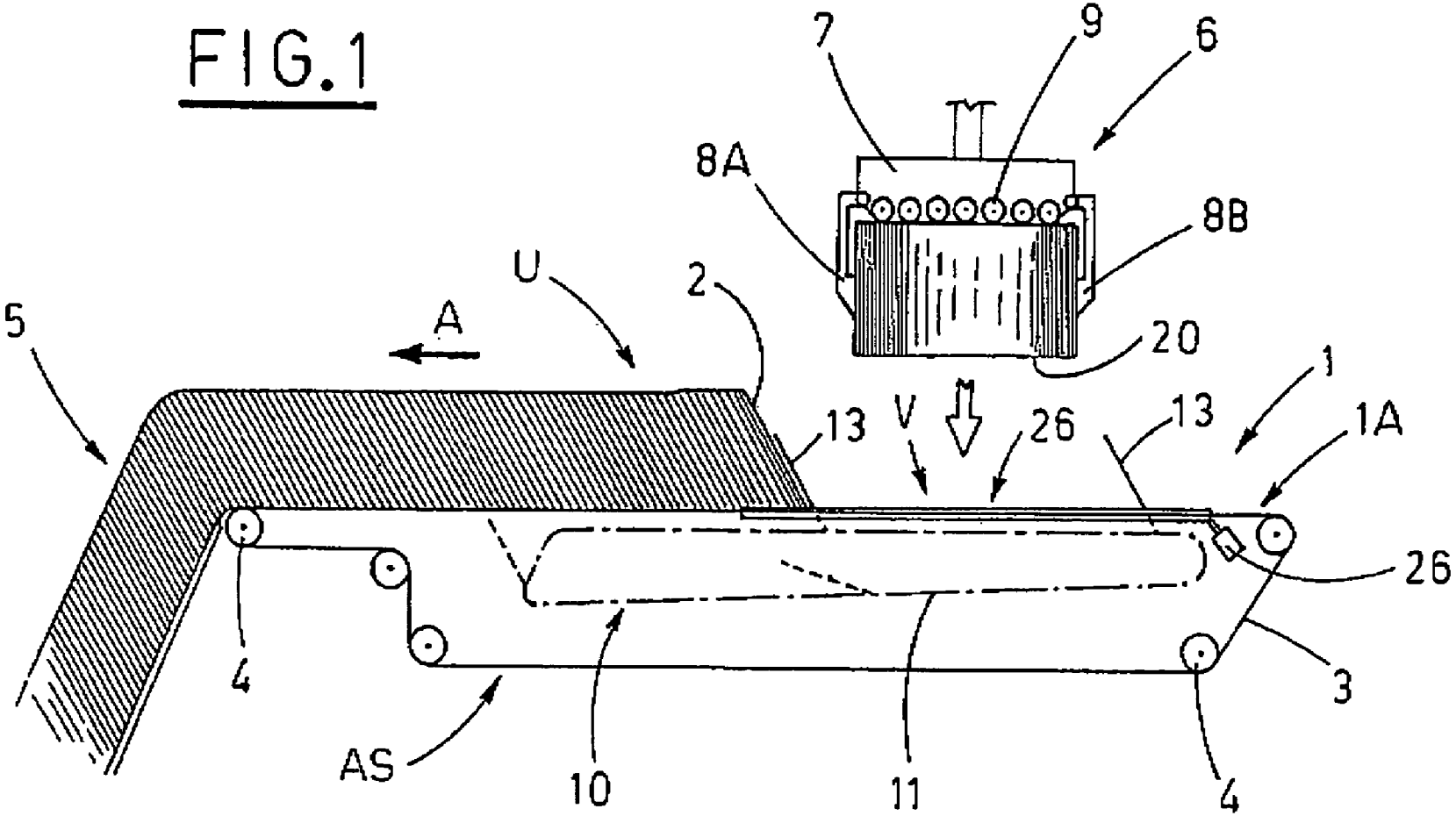
FIG. 1 is a lateral schematic view, with some parts removed for sake of clarity, of a preferred but not limiting embodiment of a unit for feeding blanks to a boxing machine, which carries out the method proposed by the present invention.

With reference to FIG. 1, reference letter U indicates a unit for feeding blanks 2 to a boxing machine AS.

Figure 6:
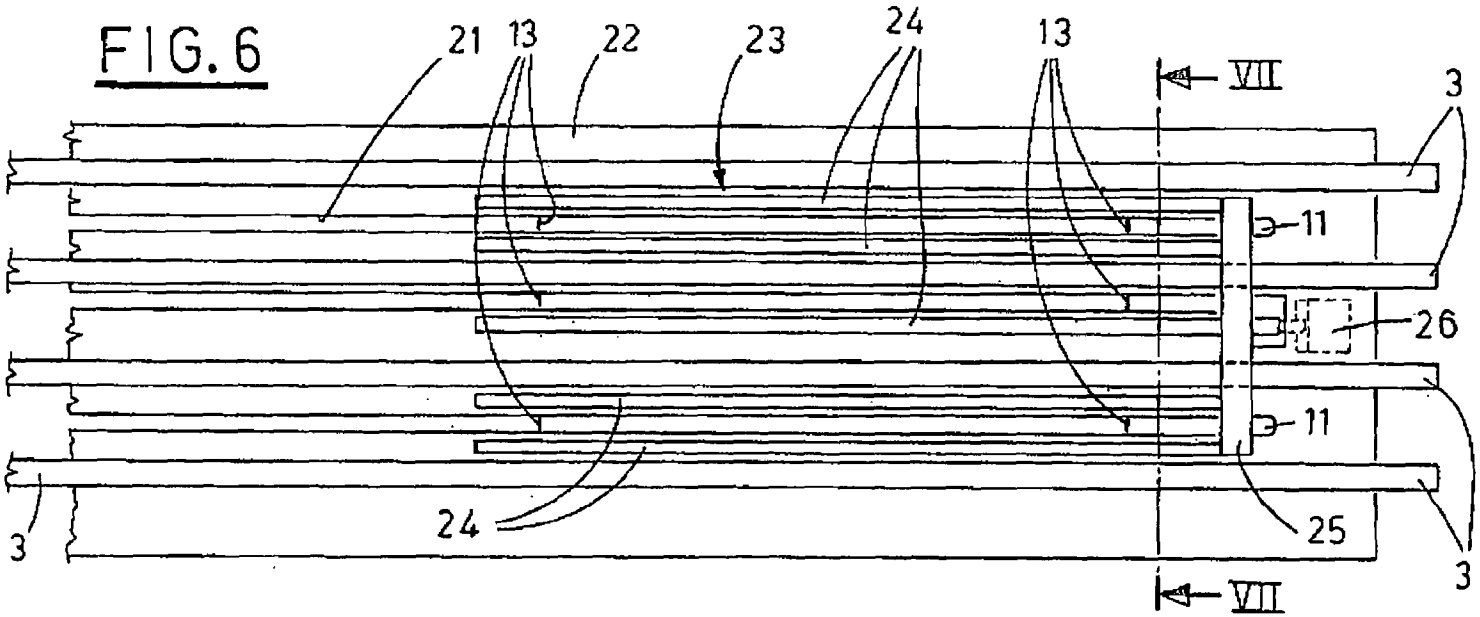
FIG. 6 is a corresponding plan view of FIG. 5.
Figure 7A:
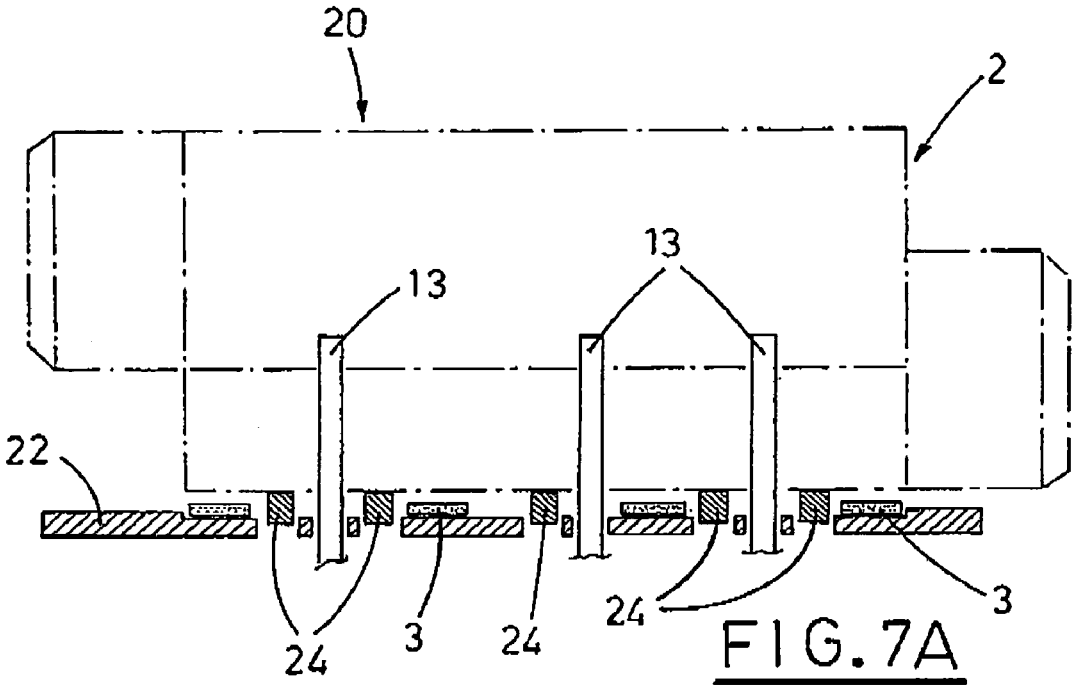
FIGS. 7A and 7B are section views of the proposed unit taken along the broken line VII—VII of FIG. 6, in different working steps.
Figure 7B:
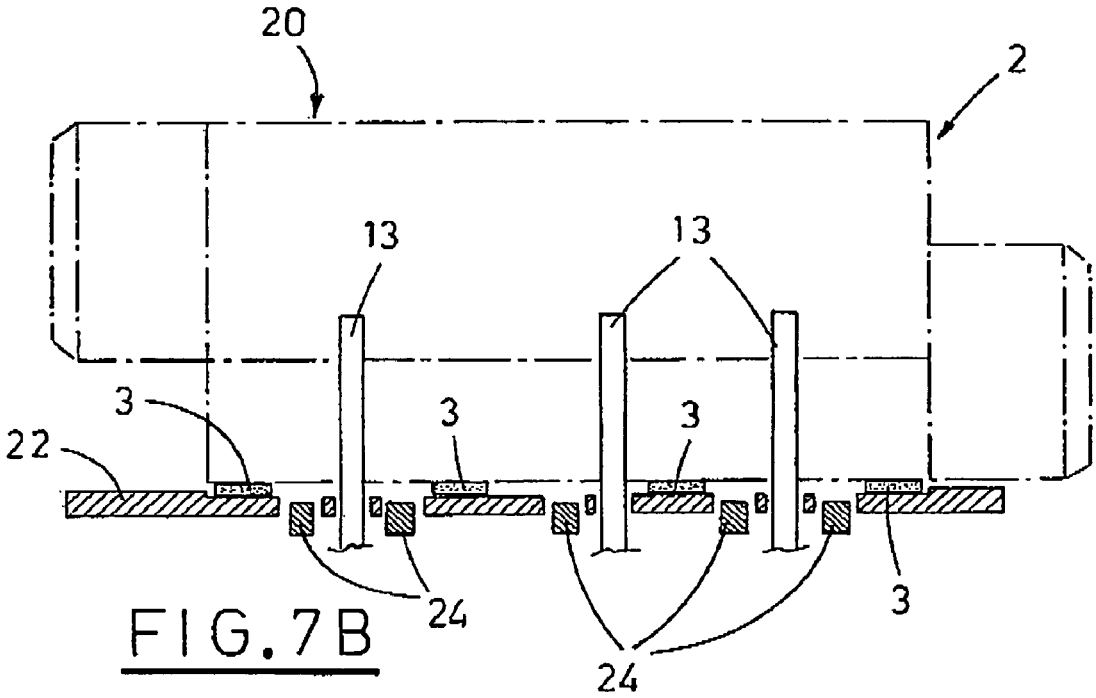

The unit U includes a feeding line 1, which in turn includes a conveyor 1 formed by belts 3 (four parallel belts as shown in FIGS. 6, 7A and 7B), which are mounted on a series of pulleys 4, suitably power-driven, along a close-loop path which defines an active upper run extending horizontally, for better clarity later on indicated with 1A, and which defines a horizontal transport surface P. The belts are continuously operated.

The upper run 1A of the conveyor 1 moves forward the blanks 2 in flat configuration, arranged one beside another, leaning against a side and inclined from down upwards with respect to the forward movement direction A.

The blanks 2 are gathered at the outlet of the upper run 1A of the conveyor 1, maintaining the same inclination, in a magazine 5, situated therebelow, from which they are picked up one by one for further packaging steps.

The unit U includes also a pick up and transfer device 6, including in turn a head 7, carried by cartesian-coordinate operated robot means, which move along three orthogonal axes.

The head 7 picks up groups 20 of blanks 2, one after another, according to known procedures, from a support surface (known and not shown, e.g. a loading platform or pallet), and transports the groups of blanks, still one after the other, to the above feeding line 1.

In particular, the head 7 carries a pair of gripping arms 8A, 8B, respectively a fore arm and a rear arm, with reference to the direction A, which grip, between themselves, each group 20 of flattened blanks 2.

Figure 2:
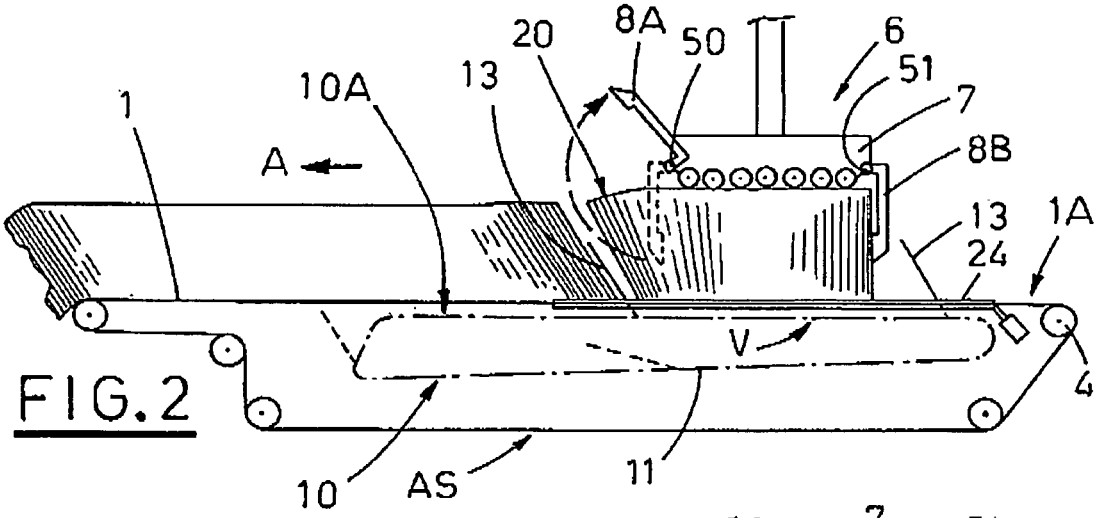
FIGS. 2, 3 and 4 are lateral views of the unit of FIG. 1 in subsequent working steps.
Figure 3:
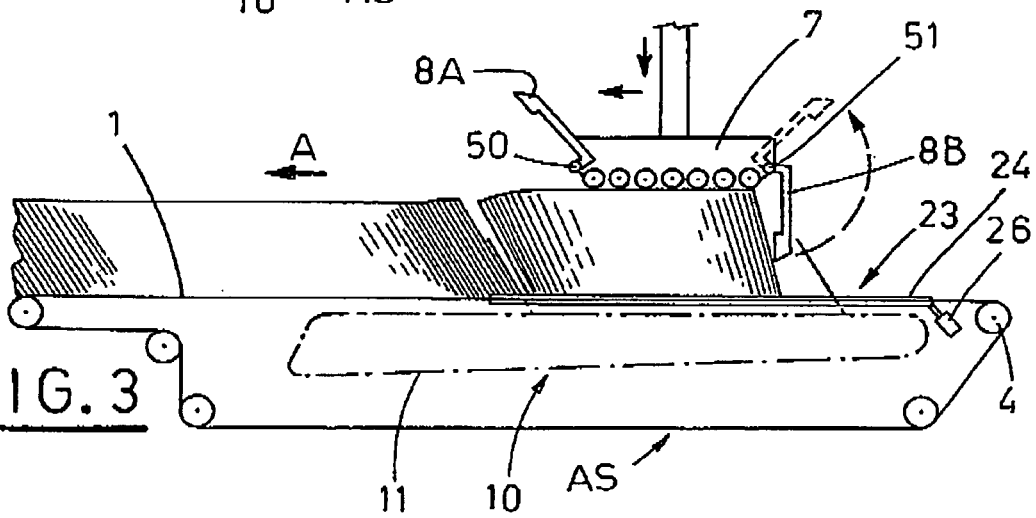
Figure 4:
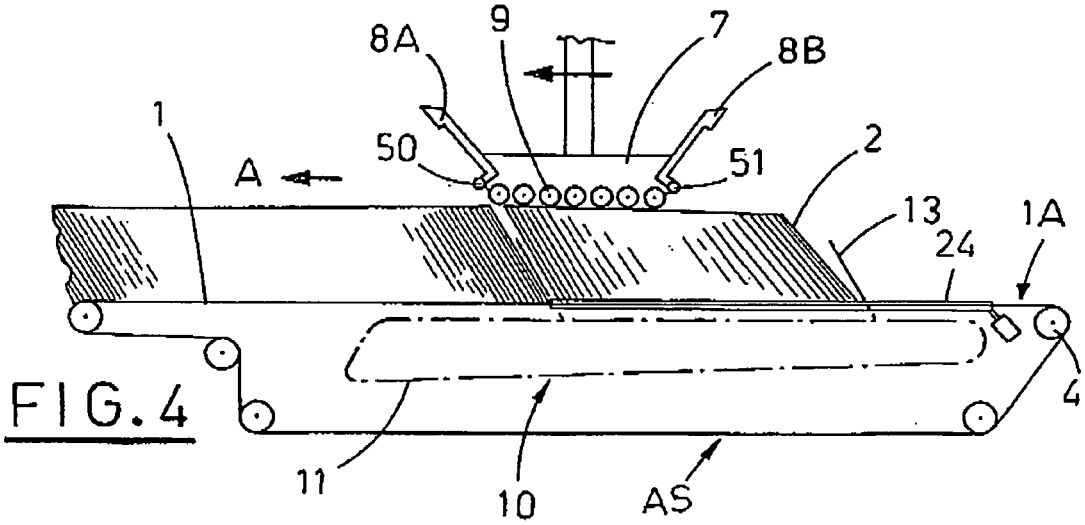

The gripping arms BA, 8B are pivoted at top to the head 7 about respective parallel and horizontal pins 50, 51, crosswise to the direction A (FIGS. 2–4).

According to what is shown in FIG. 4, the head 7 carries also a plurality of idling rollers 9, arranged one beside another on a horizontal plane and rotating about axes orthogonal to the above direction A.

The conveyor 1 with belts 3 cooperates with a further conveyor 10 with belts 11 (three belts as shown in FIGS. 6, 7A and 7B), which is trained around relative pulleys 12 along a close-loop path, which defines an active upper run, for better clarity indicated with 10A, extending horizontally below the transport surface P (FIG. 5) defined by the run 1A of the conveyors 3 of the line 1.

The conveyor 10 is moved continuously in the same direction (direction A) and with the same peripheral speed as the conveyor 1, and likewise it is a pocket conveyor, with the belts 11 carrying, hinged and regularly spaced apart, a plurality of prongs 13, with the upper part inclined forward with respect to the forward movement direction A, like the blanks 2 already present on the upper run 1A, so that a corresponding pocket V is defined between two consecutive prongs 13, to receive, as will be explained in the following, a group 20 of blanks 2 in flat configuration.

Figure 5:
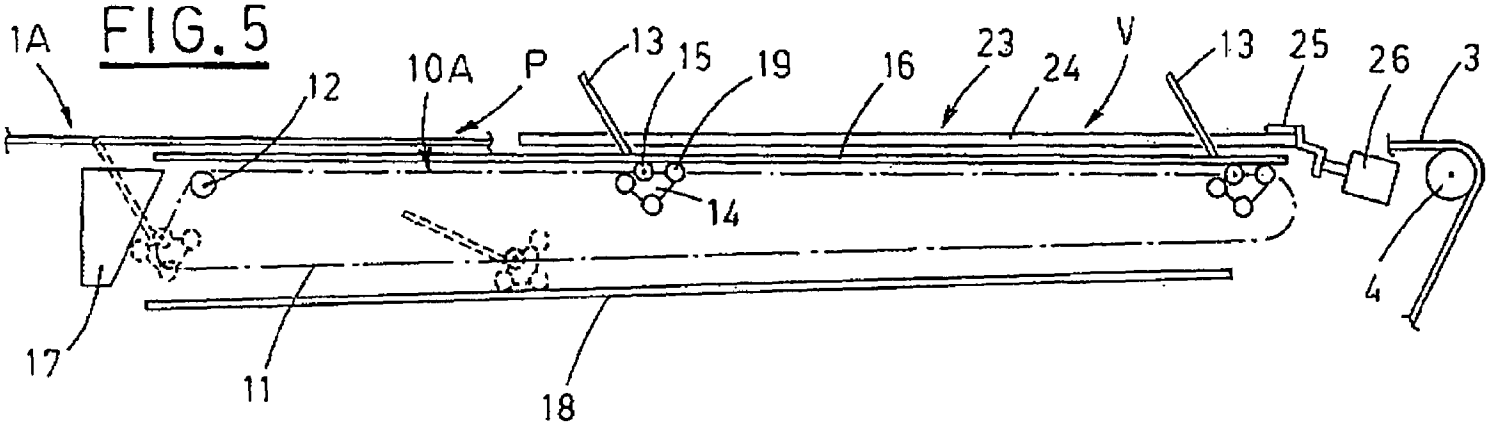
FIG. 5 is a lateral detailed view of an enlarged particular of the unit of FIG. 1.

According to FIG. 5, in the region corresponding to the upper active run 10A, the prongs 13 of the conveyor 10 protrude in a direction substantially radial with respect to the corresponding upper active run 1A of the conveyor 1.

Moreover, according to what has been better shown in FIG. 5, the pocket conveyor 10 cooperates actively with the conveyor 1, in the region corresponding to the upper run 1A, along a common section T, which corresponds to its whole upper run 10A.

The above mentioned prongs 13 pass through corresponding longitudinal slots 21 made along a support surface 22 of the surface P, on which the belts 3 slide in the region corresponding to the upper run 1A of the conveyor 1 (FIG. 6).

More precisely, according to what has been shown in FIG. 5, the prongs 13 are fastened to the belts 11 by respective oscillating supports 14 with rollers 19, hinged on relative pins 15.

The rollers 19 of the above mentioned supports 14 are aimed at following an upper longitudinal guide 16, which is aimed at maintaining the inclination imposed by the prongs 13; this inclination is maintained during use also in the region corresponding to the fore section of the conveyor 10, because the rolls 19 engage with a suitable abutment 17.

A lower guide 18 determines lowering of the prongs 13 in a spread position in order to avoid interferences.

In the area where the groups 20 of blanks 2 are loaded onto the feeding line 1, the unit U includes also a device 23 for receiving and supporting the groups 20 of blanks 2.

According to what has been better shown in FIGS. 7A and 7B, the device 23 includes a plurality of strips 24, suitably spaced apart, parallel to one another and to the line 1; the rear ends of the strips 24 are fastened to cross-bar 25.

The device 23 is aimed at being reciprocated, by a known actuator 26, crosswise to the direction A, between a raised position, in which the strips 24 are placed slightly above the transport surface P of the line 1, so as to receive and support each group 20 of blanks 2 released by the head 7 between two successive prongs 13 defining a pocket of the conveyor 10 (FIGS. 2 and 7A), and a lowered position, in which the strips 24 are placed slightly below said transport surface P (FIG. 7B), so that the group 20 of blanks 2 rests upon the belts 3 of the conveyor 1.

Operation of the unit U is in accordance with the following working mode.

After the picking up head 7 had picked up a group 20 of blanks 2 from the support surface (loading platform or pallet), clamping the group between the arms 8A and 8B, it moves the group 20 and releases it on the strips 24, shifted to their raised position, in such a way that the group is placed in the pocket defined between two prongs 13 of the conveyor 10.

The group 20 is released by a first rotation or opening of the fore gripping arm 8A of the head 7 and then a subsequent rotation or opening of the rear gripping arm 8B of the head 7, so as to determine a substantially controlled expansion of the blanks 2 of the group 20, between and against the prongs 13, as pointed out in sequence in FIGS. 2 and 3; thus, there is no possibility that any blank 2 moves in an undesired way or even overturns hindering consequently the line 1.

Simultaneously, the head 7 is moved forward in a direction parallel to the direction A and with the speed suitably higher than the speed of the line 1, so as to operate, by a group of rollers 9, a rolling step for the tops of the blanks 2 in order to make the arrangement of the blanks 2 uniform.

Afterwards, the strips 24 are moved from the raised position to the lowered position, so that the group 20 rests upon the belts 3 moving in the feeding direction A, still placed between the inclined prongs 13 of the conveyor 10, which cooperates with the belts 3 along the whole common section T.

In the region corresponding to the terminal part of the section T, the fore prong 13 carried by the belts 11 disappears gradually due to the descent of the fore area of the conveyor 10 (maintaining the inclination assumed previously, as a consequence of the engaging of the supports 14 with the rollers 19 with the abutment 17), and then the group 20 becomes, as a matter of fact, an integral part of the magazine 5 of blanks 2, which feeds correctly in step relation the boxing machine AS, with the blanks 2 going down into the magazine 5 maintaining the same inclined orientation.

Thus, the blanks 2 are fed efficiently and continuously without inconvenient stops of the boxing machine AS caused by jamming of the blanks 2.

The proposed method allows high production rates, therefore it is adequate to the characteristics of the modern boxing machines.

The invention claimed is:

1. A method for feeding blanks (2) along a continuous feeding line to a boxing machine (AS), the blanks fed in a forward movement direction (A), the method comprising:

providing a horizontal pocket conveyor (10, 11) for feeding blanks to the feeding line, picking up a group (20) of blanks (2) in a flat configuration from a support platform;

releasing each group (20) of blanks (2) between two adjacent prongs (13) extending upwardly from said horizontal pocket conveyor, said adjacent prongs defining a relative pocket (V) therebetween;

locating receiving and supporting means (23) within the pocket, said receiving and supporting means being movable for moving the receiving and supporting means between a raised position and a lowered position;

receiving said group of blanks on said receiving and supporting means when disposed in the raised position where said receiving and support means (23) are slightly raised with respect to a surface of said feeding line (1);

moving said receiving and support means (23) to said lowered position which is slightly lowered with respect to said surface of said feeding line for transferring said group of blanks onto the surface of the feeding line; and, moving said group of blanks on said feeding line (1) in the forward movement direction (A) to said boxing machine.

2. The method according to claim 1 wherein said group of blanks (2) is picked up by clamping the group of blanks between at least one pair of gripping arms (8A, 8B) of a picking up head (6, 7), the gripping arms being pivotable on respective rotation pins (50, 51), said group (20) of blanks (2) being released by rotating a forward gripping arm (8A) in a forward direction with respect to said forward moving direction (A) and subsequently rotating a rear gripping arm (8B) away from said group of blanks (2).

3. The method according to claim 1 wherein the feeding line includes a second conveyor (1, 3), and moving said pocket conveyor (10, 11) in the same forward movement direction (A) and with the same speed as said second conveyor (1, 3), along a predetermined common section (T).

4. The method according to claim 3 wherein said pocket conveyor (10, 11) and second conveyor (1, 3) are belt conveyors (11, 3) having active runs (10A, 1A) extending parallel to each other and to said forward movement direction (A), said common section (T) corresponding to the entire active run (10A) of said pocket conveyor (10, 11).

5. The method according to claim 2 further comprising moving the picking up head (7) forward during release of said group (20) of blanks (2) in a direction parallel to said forward movement direction (A) and with a speed corresponding to a speed of said feeding line (1), and further comprising rolling tops of said blanks (2) of the group (20) of blanks (2) to uniformly arrange the blanks (2) between said prongs (13).

6. The method according to claim 2 wherein the feeding line includes a second conveyor (1, 3), and moving said pocket conveyor (10, 11) in the same forward movement direction (A) and with the same speed as said second conveyor (1, 3), along a predetermined common section (T).

7. The method according to claim 3 further comprising moving the picking up head (7) forward during release of said group (20) of blanks (2) in a direction parallel to said forward movement direction (A) and with a speed corresponding to a speed of said feeding line (1), and further comprising rolling tops of said blanks (2) of the group (20) of blanks (2) to uniformly arrange the blanks (2) between said prongs (13).

8. The method according to claim 4 further comprising moving the picking up head (7) forward during release of said group (20) of blanks (2) in a direction parallel to said forward movement direction (A) and with a speed corresponding to a speed of said feeding line (1), and further comprising rolling tops of said blanks (2) of the group (20) of blanks (2) to uniformly arrange the blanks (2) between said prongs (13).

* * * * *